US007350265B2

(12) United States Patent
Zhang

(10) Patent No.: US 7,350,265 B2
(45) Date of Patent: Apr. 1, 2008

(54) SELF-CONTAINED HANDHELD DRAIN CLEARING COMPRESSED AIR DEVICE

(76) Inventor: Yun Bing Zhang, Rm 1101, Block No.64, 258 Tian Deng Road, Shanghai (CN) 200237

( * ) Notice: Subject to any disclaimer, the term of this patent is extended or adjusted under 35 U.S.C. 154(b) by 641 days.

(21) Appl. No.: 10/983,479

(22) Filed: Nov. 8, 2004

(65) Prior Publication Data

US 2006/0096060 A1 May 11, 2006

(51) Int. Cl.
*A47L 5/00* (2006.01)

(52) U.S. Cl. ..... 15/406; 15/407

(58) Field of Classification Search ..... 15/405, 15/406, 407

See application file for complete search history.

(56) References Cited

U.S. PATENT DOCUMENTS 4,282,852 A * 8/1981 Omana ..... 124/67

6,203,397 B1 * 3/2001 Applewhite et al. ..... 446/475

* cited by examiner

*Primary Examiner*—Joseph J. Hail, III
*Assistant Examiner*—Shantese L McDonald
(74) *Attorney, Agent, or Firm*—Richard D. Clarke

(57) ABSTRACT

A self-contained handheld drain clearing device is provided that uses compressed air to unblock various household drains and pipes. The device comprises an upper body and a lower body. The upper body includes a cylindrical chamber for housing a manual pump. A one-way inlet valve allows compressed air to enter a collection chamber, from which it exits to a storage chamber through a small hole in a piston. A trigger component is located in the upper body of the device, as is a pressure release safety component included for user protection. The lower body of the device primarily serves as a storage area for compressed air, containing an upper end and a lower end. The upper end contains threads for joining the lower body with the upper body, while the lower end contains a fitting for receiving various drain-sealing adapters.

16 Claims, 5 Drawing Sheets

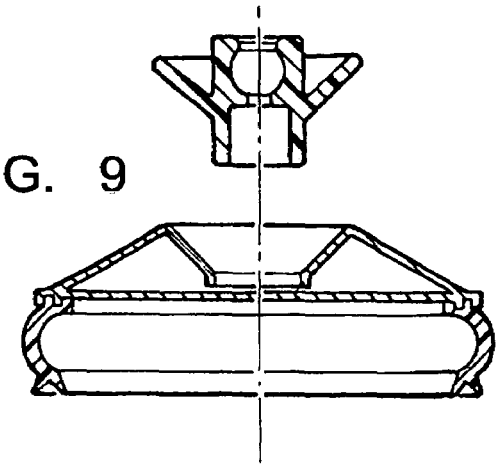
FIG. 9
FIG. 10
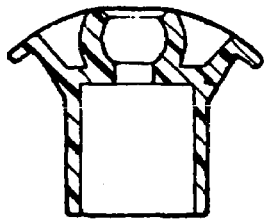
FIG. 11
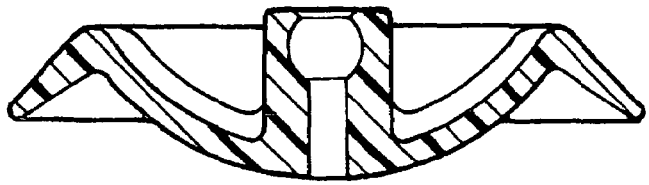
FIG. 13
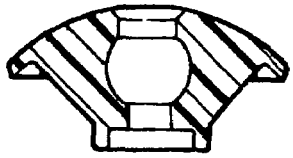
FIG. 12
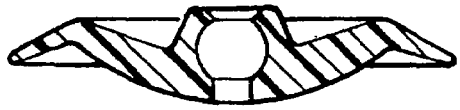
FIG. 14
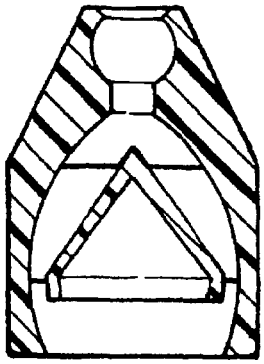
FIG. 15
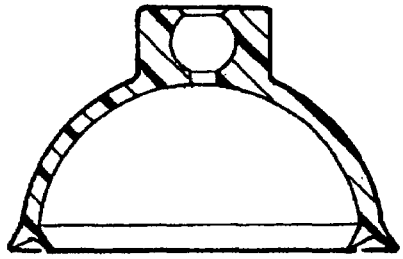
FIG. 16
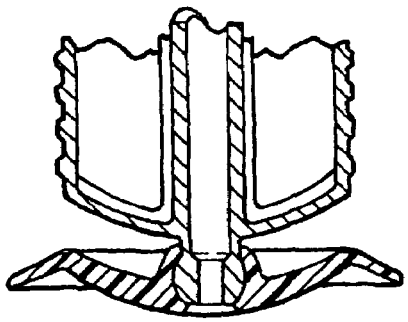
FIG. 17

SELF-CONTAINED HANDHELD DRAIN CLEARING COMPRESSED AIR DEVICE

FIELD OF THE INVENTION

This invention relates to the field of drain clearing devices. More specifically, this patent deals with a self-contained handheld device that provides a burst of user generated compressed air to unblock household drainage pipes, surface drains, tubs, basins, sinks, and toilets.

BACKGROUND OF THE INVENTION

The blockage of drains and pipes is an occurrence that affects millions of households per year. If not immediately cleared, a blockage could lead to a build up of septic and or putrid water in and around the house. Such a condition can often be remedied by the use of chemicals. However, chemicals are not reusable, can be harmful to the environment, present a potential danger to people that are exposed to or accidentally ingest them, and can corrode the pipes in which they are poured. The services of a professional plumber can be utilized as an alternative to drain clearing chemicals. While the use of a plumber would assuredly eliminate the blockage, it is significantly more expensive. The use of handheld devices is the remaining option to clear a clogged drain or pipe.

A conventional plunger, comprising a rubber suction cup attached to the end of a wooden or metal handle, is the primary handheld device used for clearing clogged drains and pipes. To operate, the suction cup is placed over the clogged area and the user forces the handle up and down causing the suction cup to create a suction force over the clogged area. This force either sucks or pushes the clogged material free, clearing the pipe or drain. Although plungers are generally inexpensive, there are several drawbacks to their use. First, they can require a significant amount of energy and patience to clear the blockage. There can only be a limited amount of force generated by the suction cup, and this force cannot be maintained over great lengths to remove any remote clogs. Thus, a user must continuously and vigorously move the handle up and down to create any significant amount of force. Second, using a plunger can lead to a messy situation, as splashing of water and material can occur if the plunger is not properly sealed to the drain or pipe. Third, the use of a plunger can be inefficient and ineffective if the suction cup does not properly fit over the drain or pipe, as the suction force will not be as great. Finally, plungers can be bulky and difficult to conveniently store.

Many drain clearing devices that try to eliminate one or more of the drawbacks of the standard plunger have been invented and patented. Pertinent prior art directed towards these drain clearing devices can be found in U.S. Pat. No. 4,629,128 (Lawrence), U.S. Pat. No. 5,199,114 (Christopher), U.S. Pat. No. 5,669,099 (Porcasi), U.S. Pat. No. 5,940,897 (James), U.S. Pat. No. 6,526,601 (Kou Hsiao), and U.S. Pat. No. 6,550,074 (Allenbaugh et al.), all incorporated by reference herein.

U.S. Pat. No. 5,199,114 describes a drain clearing device having a transparent and hollow cylindrical body, a piston plunger assembly partially disposed in the cylindrical body, a piston plunger assembly support attached to an upper end of the cylindrical body, and a drain seal attached to a lower end of the cylindrical body. The preferred embodiment of the drain seal comprises a half doughnut-shaped drain seal head formed from medium density, closed cell sponge rubber, a drain seal head bearing plate fixedly attached to the drain seal head, and a drain seal neck fixedly attached to the drain seal head bearing plate. The drain seal neck attaches to the cylindrical body in sealing engagement.

While this invention is an improvement over the standard plunger device in that it provides a means for observing when clogged debris are removed from the drain or pipe and provides better sealing, it still has shortcomings. This device does not provide for a variety of drain-sealing adapters that can be used to fit various drains or pipes. Additionally, a user must either rapidly move the handle up and down or continue moving the handle up and down for a prolonged period to create the amount of force necessary clear a large amount of clogged material. Therefore, it would be highly desireable to have a self-contained and easy to operate handheld device that allows for the rapid, clean, environmentally-safe, cost-effective, and readily repeatable clearing of a variety of clogged drains and pipes.

The invention patented in U.S. Pat. No. 5,940,897 involves a plunger having a handle, an upper cylinder, a lower cylinder, and a nozzle. The bottom portion of the upper cylinder fits over the top portion of the lower cylinder. The handle may be grasped to push the upper cylinder down over the lower cylinder to force compressed air out through the nozzle, or to pull the upper cylinder up to create a vacuum to suck air and/or fluids up. A disc shaped piston compresses the air inside the lower cylinder when the upper cylinder to which the piston is attached moves down, and creates a partial vacuum when it moves up. The piston is attached by a rod to the handle and the upper cylinder. A spring in the space between the upper and lower cylinders biases the upper cylinder towards a set position with respect to the lower cylinder, and resists movement either upward or downward from the set position. Through the center of the nozzle is an aperture, through which air and fluids may move. The sides of the aperture are formed by an inner ring, which is surrounded by a circular cavity that separates the inner ring from an outer ring.

This patent additionally relies on an up and down pumping action to clear clogged material. While an improvement over the standard plunger, this invention does not provide for a quick, pressurized burst of air that can rapidly clear drains or pipes. Additionally, the design of the nozzle limits the types of drains or pipes that can cleared with this device. Therefore, it would be highly desireable to have a self-contained and easy to operate handheld device that allows for the rapid, clean, environmentally-safe, cost-effective, and readily repeatable clearing of a variety of clogged drains and pipes.

U.S. Pat. No. 6,526,601 provides a drain cleaner which comprises a casing having an aperture defined in a first end thereof and a tube that is engaged with the opening. A high pressure can is received in the casing and includes a valve which is located in alignment with a shrink opening of the tube. A spring is connected between the can and an inside of the first end of the casing. A rod movably extends through a second end of the casing is pushed to move the can to generate a high pressure through the tube.

This patent utilizes a pressurized can to clear clogged pipes and drains. Although this invention is an improvement over the previously described devices in that it requires less effort by a user to clear a blockage, it does not offer a device that can be reused without the purchase of additional items. When the pressurized contents of a can are emptied the user must purchase a new can to unblock future clogged areas, leading to increased costs and time expended. Additionally, the user is limited in the type of blockage that can be cleared by the amount of pressure that each can possesses. Further, this invention does not allow the user to adapt the device to fit a variety of drains or pipes. Therefore, it would be highly desireable to have a self-contained and easy to operate handheld device that allows for the rapid, clean, environmentally-safe, cost-effective, and readily repeatable clearing of a variety of clogged drains and pipes.

The plumbing device described in U.S. Pat. No. 6,550,074 uses a compressed gas and a burst disk having a relatively even surface of substantially uniform thickness to produce a sudden discharge of energy to forcibly act against any obstruction that may interfere with the proper function of a drain. The plumbing device has a cylindrical chamber for receiving the compressed gas and may generally take the shape of a plunger, which is flexible to use and is easy to store. A portion of the chamber forms a receiving chamber with the burst disk for harnessing and directing the energy of the compressed gas to clear the drain.

This invention additionally uses a burst of compressed air to clear blockages. The device cannot be continuously used without dismantling however. After each use, the burst disk must be replaced by detaching the lower chamber from the upper chamber and placing a new disk above a washer secured to the lower chamber. Similarly, a new compressed air canister must be purchased and installed when the existing canister becomes empty. This not only adds increased costs, but also increased time and effort to use the device. Additionally, the amount of pressure that is delivered to the clogged area is not easily variable, but dependent upon the thickness of the burst disk used. For greater pressure released, either a thicker burst disk must be purchased and used or multiple thinner burst disks must be stacked together. Further, a user must stand and use both hands to operate this device, complicating and preventing its use in tight areas. Finally, this device is not easily adaptable to different sized drains or pipes, creating a scenario that is potentially conducive to inefficient and ineffective results. Therefore, it would be highly desireable to have a self-contained and easy to operate handheld device that allows for the rapid, clean, environmentally-safe, cost-effective, and readily repeatable clearing of a variety of clogged drains and pipes.

U.S. Pat. No. 5,669,099 discloses a new and improved hand-held drain cleaning system employing pressurized air to dislodge clogs from a drain. The system includes a main housing defined by a handle component and a minor housing component. The handle component includes a rod and piston for use in delivering compressed air to the minor housing. The device further includes a spring-biased trigger for use in selectively delivering compressed air from the device into a clogged drain. Furthermore, the system includes a plurality of drain closure members of various sizes adapted to fit into various sized drains.

This invention utilizes a manual pump to generate compressed air for clearing clogged drains and pipes. Its substantial departure from the prior art lies in its inclusion of a plurality of drain closure members of various sizes adapted to fit into various sized drains. While an improvement, this device is deficient in certain respects. First, the forward portion of the device that stores compressed air has little capacity, either preventing the dislodging of larger blockages, or requiring multiple air bursts to do so. Second, there is no safety feature incorporated into the device to help to prevent unintended damage to the user. Third, the air discharge method employed has the potential to create air leakage after repeated use. A resilient spring is relied upon to rebound the trigger into a position to close the stopper and block air from entering the cylindrical discharge passage. After multiple depressions of the trigger, the spring can become less resilient and cause the formation of a less-tight seal between the stopper and the cylindrical passage. This can result in decreased blockage clearing effectiveness or increased costs for the user in having to purchase replacement parts. Finally, the force of the compressed air pressing the stopper against the cylindrical passage, combined with the resistance given by the resilient spring, can require a great deal of effort to depress the trigger and use the device. Therefore, it would be highly desireable to have a self-contained and easy to operate handheld device that allows for the rapid, clean, environmentally-safe, cost-effective, and readily repeatable clearing of a variety of clogged drains and pipes.

The invention patented in U.S. Pat. No. 4,629,128 is an apparatus for discharging a high pressure burst of air against a column of standing water behind an obstruction in a drain line to create shockwaves in the water column to remove the obstruction, including a hollow gun body having a discharge opening and a pistol grip handle connected to the gun body. A discharge valve is connected to a piston dividing the interior of the gun body into two chambers, the pressurization and de-pressurization of which is controlled by a trigger operated pilot valve. Air is quickly exhausted from a rearward chamber by depressing the trigger and pilot valve, causing the piston and valve to snap rearward to open the discharge opening and direct a burst of pressurized air from a forward chamber to exit through the discharge opening and into a drain line.

This invention requires some type of air supply device, whether it be an air hose or pressurized canister. Additionally, this device does not provide a variety of sealable adapters that can be used to fit various drains and pipes. Further, this device does not incorporate any safety features for user protection. Finally, the discharge of the pressurized air does not occur in a directed and confined manner, potentially eliminating some of the effectiveness in clearing larger blockages. Therefore, it would be highly desireable to have a self-contained and easy to operate handheld device that allows for the rapid, clean, environmentally-safe, cost-effective, and readily repeatable clearing of a variety of clogged drains and pipes.

SUMMARY OF THE INVENTION

Set forth is a brief summary of the invention in order to solve the aforementioned problems and achieve the foregoing advantages in accordance with the purposes of the present invention as embodied and described herein.

The principle advantage of this invention is that it provides a low-cost handheld device that uses compressed air to deliver a directed, high-pressure force to unblock a variety of household drainage pipes, surface drains, tubs, basins, sinks, and toilets.

Another advantage of this invention is that it provides a method for unblocking a variety of household drainage pipes, surface drains, tubs, basins, sinks, and toilets that does not use environmentally harmful chemicals.

Yet another advantage of this invention is that it provides a device that can quickly and efficiently unblock a variety of household drainage pipes, surface drains, tubs, basins, sinks, and toilets.

Still another advantage of this invention is that it provides a drain clearing device that is portable, lightweight, easy to use, and convenient to store.

Yet another advantage of this invention is that it provides a drain clearing device that incorporates a pressure release component for user protection.

A final advantage of this invention is that it does not involve the purchase of replacement parts, such as burst disks or compressed air canisters, allowing for lower costs and continuous use without dismantling.

The present invention provides a new and improved self-contained handheld drain clearing device that uses compressed air to unblock various household drains and pipes. The device comprises an upper body and a lower body. The upper body includes a cylindrical chamber for housing a manual pump. A one-way inlet valve allows compressed air to enter a collection chamber, from which it exits to a storage chamber through a small hole in a piston. A trigger component is located in the upper body of the device, as is a pressure release safety component included for user protection. The lower body of the device primarily serves as a storage area for compressed air, containing an upper end and a lower end. The upper end contains threads for joining the lower body with the upper body, while the lower end contains a fitting for receiving various drain-sealing adapters.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE DRAWINGS

The accompanying drawings, which are incorporated in and form a part of this specification, illustrate embodiments of the invention and together with the description, serve to explain the principles of this invention.

FIG. 9 depicts a cross-sectional view of a detachable drain-sealing adapter to be used with the drain clearing compressed air device for unclogging sinks and basins, constructed in accordance with the present invention;

FIG. 10 depicts a cross-sectional view of a detachable drain-sealing adapter to be used with the drain clearing compressed air device, in conjunction with the adapter to unclog sinks/basins shown in FIG. 9, for unclogging open surface drains, bathtubs, or toilets, constructed in accordance with the present invention;

FIG. 11 depicts a cross-sectional view of another detachable drain-sealing adapter to be used with the drain clearing compressed air device for unclogging sinks and basins, constructed in accordance with the present invention;

FIG. 12 depicts a cross-sectional view of another detachable drain-sealing adapter to be used with the drain clearing compressed air device for unclogging sinks and basins, constructed in accordance with the present invention;

FIG. 13 depicts a cross-sectional view of another detachable drain-sealing adapter to be used with the drain clearing compressed air device for unclogging surface drains or bathtubs, constructed in accordance with the present invention;

FIG. 14 depicts a cross-sectional view of another detachable drain-sealing adapter to be used with the drain clearing compressed air device for unclogging surface drains and toilets, constructed in accordance with the present invention;

FIG. 15 depicts a cross-sectional view of another detachable drain-sealing adapter to be used with the drain clearing compressed air device for unclogging sinks/basins or bathtubs that contain a lift plug, constructed in accordance with the present invention;

FIG. 16 depicts a cross-sectional view of another detachable drain-sealing adapter to be used with the drain clearing compressed air device for unclogging surface drains, bathtubs, or toilets, constructed in accordance with the present invention; and FIG. 17 depicts a partial cross-sectional view of the drain clearing compressed air device with a drain-sealing adapter, as shown in FIG. 13, attached to the drain clearing compressed air device, constructed in accordance with the present invention.

Figure 1:
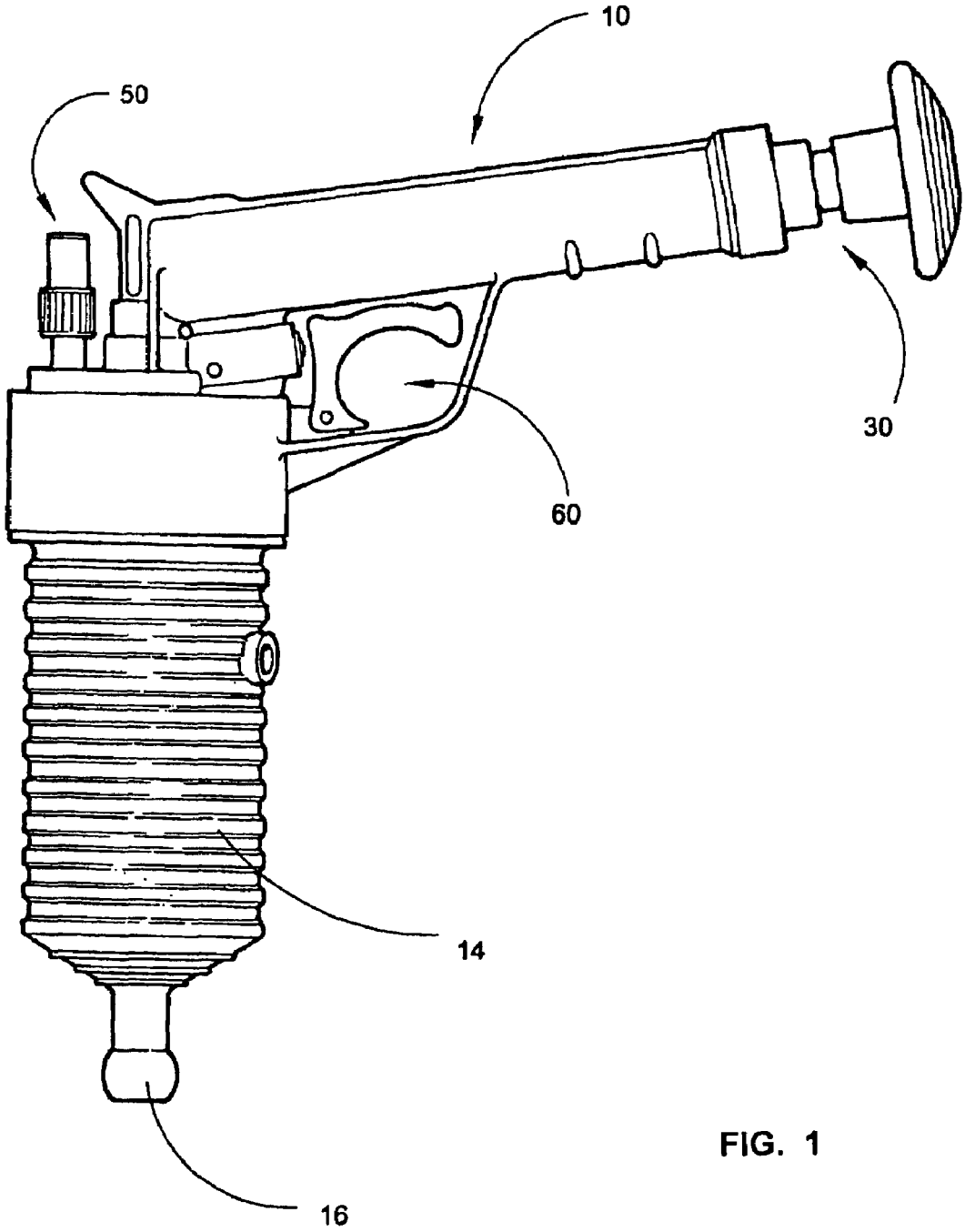
FIG. 1 depicts a side elevational view of the drain clearing compressed air device, constructed in accordance with the present invention.

For a fuller understanding of the nature and advantages of the invention, reference should be had to the following detailed description taken in conjunction with the accompanying drawings which are incorporated in and form a part of this specification, illustrate embodiments of the invention and together with the description, serve to explain the principles of this invention.

DETAILED DESCRIPTION OF THE PREFERRED EMBODIMENTS

For a fuller understanding of the nature and advantages of the invention, reference should be had to the following detailed description taken in conjunction with the accompanying drawings wherein similar parts of the invention are identified by like reference numerals.

Referring now to FIG. 1, there is shown a side elevational view of the preferred embodiment of the drain clearing compressed air device 10. A manual pump 30 is used to force compressed air into compressed air storage chamber 14. A trigger component 60 is used to release compressed air from compressed air storage chamber 14. Drain-sealing adapter fitting 16 allows drain-sealing adapters to be connected to drain clearing compressed air device 10 to enable the clearing of various pipe and drains. A pressure release safety component 50 is included for user safety.

Figure 2:
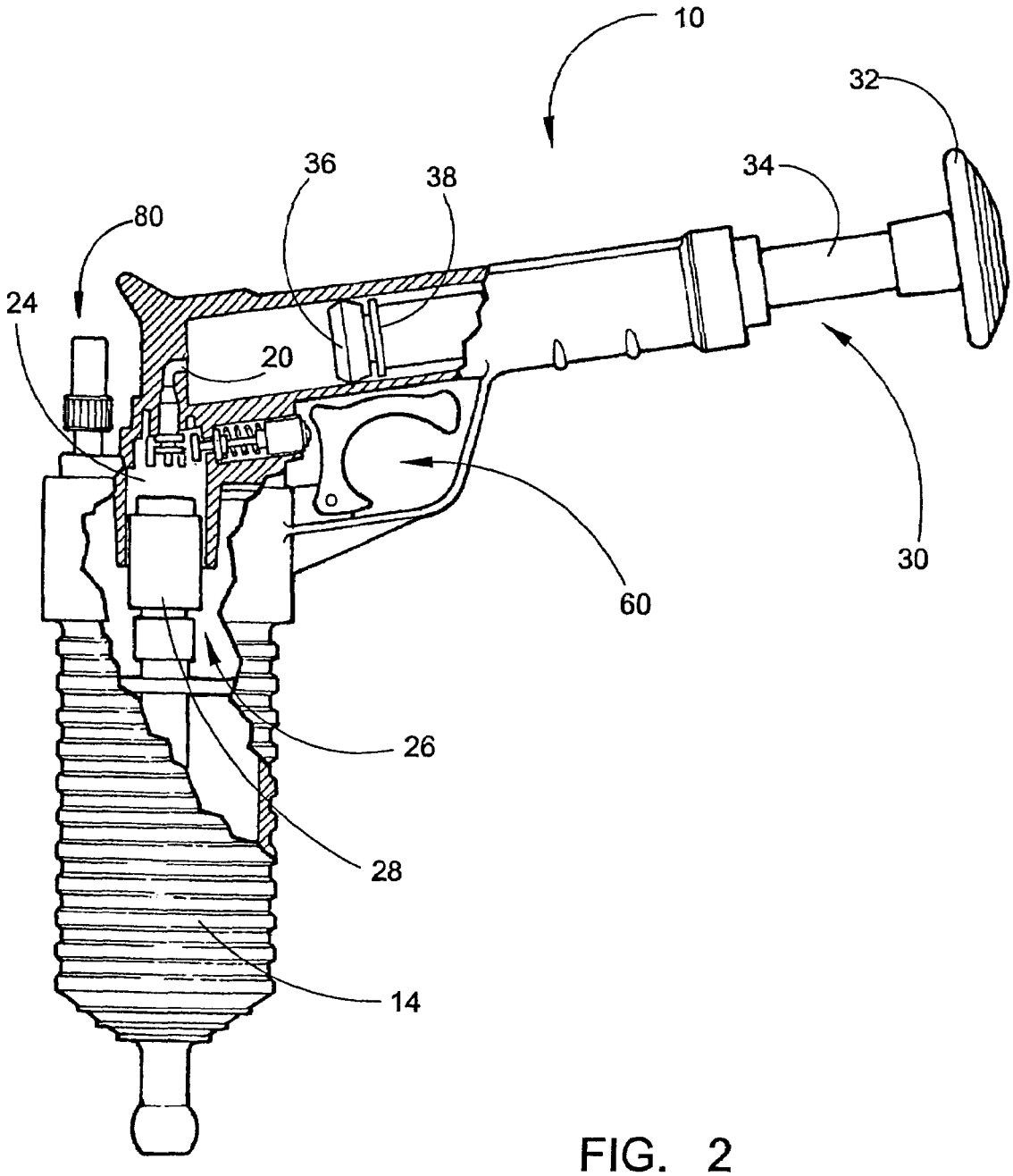
FIG. 2 depicts a partial cross-sectional view of the drain clearing compressed air device, constructed in accordance with the present invention.

Referring now to FIG. 2, there is shown a partial cross-sectional view of the drain clearing compressed air device 10. Compressed air is forced into a one-way air inlet valve 20 to compressed air collection chamber 24. As compressed air enters compressed air collection chamber 24, piston 26 is pushed forward, exposing air outlet hole 28 in piston 26. Compressed air is forced through air outlet hole 28 or a gap between piston 26 and the surrounding parts, into compressed air storage chamber 14, where it is stored prior to being released by trigger component 60. Manual pump 30 is used to force compressed air into one-way inlet valve 20. Manual pump 30 contains a pump handle 32 attached to a pump rod 34, as well as a plunger 36 attached to pump rod 34 to assist in forcing compressed air through one-way air inlet valve 20. Locking ring 38 connects plunger 36 to pump rod 34. Additionally, an alternate embodiment of the pressure release safety component 80 is shown, in place on the compressed air storage chamber 14.

Figure 3:
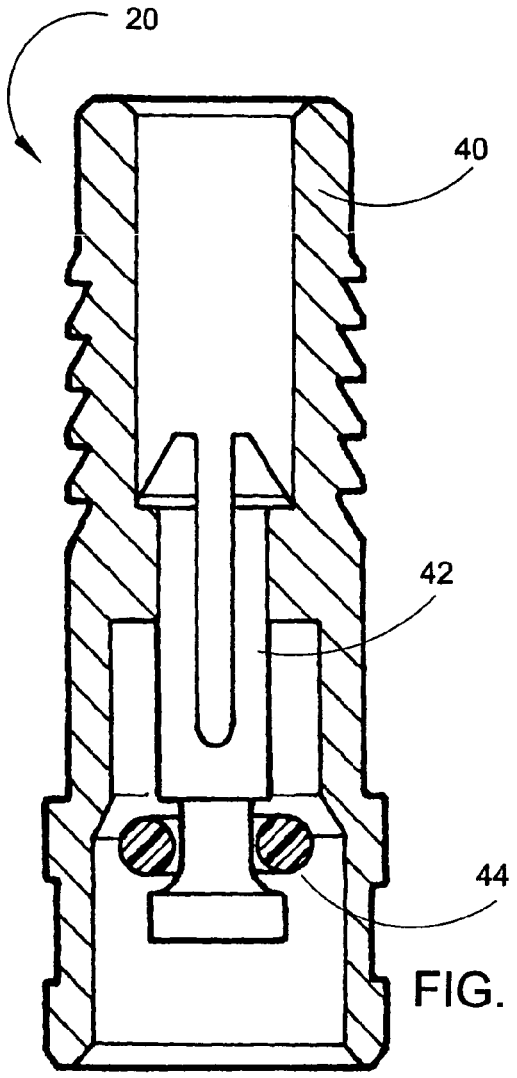
FIG. 3 depicts a cross-sectional view of a one-way air inlet valve, constructed in accordance with the present invention.

Referring now to FIG. 3, (with reference also to FIG. 2) there is shown a cross-sectional view of the one-way air inlet valve 20, which is composed of shell 40, spool 42, and seal packing ring 44. One-way air inlet valve 20 ensures that air can only enter through one opening and exit through another. When a user pumps manual pump 30 (as shown in FIG. 2) in a direction towards drain clearing compressed air device 10 (as shown in FIG. 2), compressed air is pushed into air inlet valve 20 (as shown in FIG. 2), forcing spool 42 and seal packing ring 44 into compressed air collection chamber 24 (as shown in FIG. 2). This results in an exposure of an opening from which compressed air can flow into compressed air collection chamber 24 (as shown in FIG. 2). When a user pulls manual pump 30 (as shown in FIG. 2) away from drain clearing compressed air device 10 (as shown in FIG. 2), spool 42 and seal packing ring 44 rebound back into place, preventing air leakage from compressed air collection chamber 24 (as shown in FIG. 2).

Figure 4:
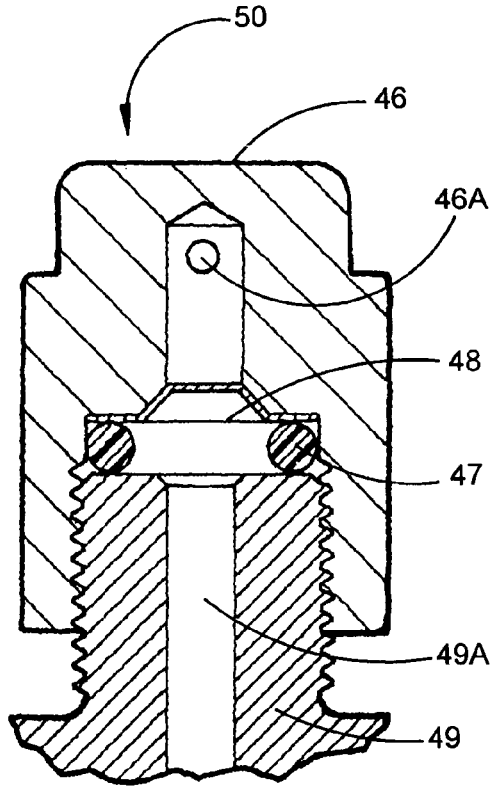
FIG. 4 depicts a cross-sectional view of a first embodiment of the pressure release safety component, constructed in accordance with the present invention.

Referring now to FIG. 4, there is shown a cross-sectional view of a first embodiment of the pressure release safety component 50. An air-tight seal is formed by threaded sealing nut cap 46, having an orifice 46A, frangible membrane 48, and membrane contacted O-ring 47. The frangible membrane 48 is replaceable, and is inserted onto the O-ring 47 before the cap 46 is threaded tight onto threaded protrusion 49. Threaded protrusion 49 is in fliud communication with the compressed air within the compressed air storage chamber 14 (see FIG. 2). If compressed air within the compressed air storage chamber 14 exceeds a certain pressure, air is forced through air passage 49A and breaks the frangible membrane 48, which allows air to safely escape the compressed air storage chamber 14 through an orifice 46A located in the threaded sealing nut cap 46.

Figure 5:
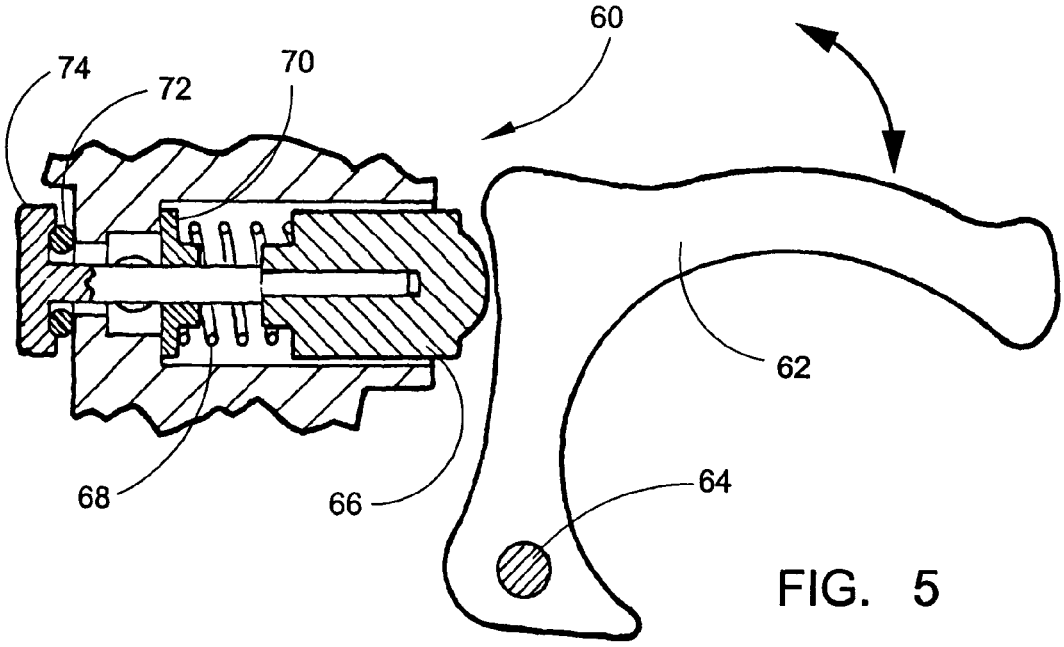
FIG. 5 depicts a cross-sectional view of the trigger component, constructed in accordance with the present invention.

Referring now to FIG. 5, there is shown a cross-sectional view of trigger component 60 used to discharge highly compressed air from compressed air storage chamber 14. Trigger component 60 is composed of trigger handle 62, pin 64, trigger piston 66, trigger spring 68, cushion 70, trigger seal packing ring 72, and needle valve 74. Trigger handle 62 is fixed to the upper body of drain clearing compressed air device 10 by pin 64, and has two positions. In the first position, trigger handle 62 is uncontacted with trigger piston 66. When trigger handle 62 is in this position the user can use manual pump 30 to build up compressed air. After the user applies an upward force to trigger handle 62, rotating it about pin 64, trigger handle 62 is in the second position. In the second position, trigger handle 62 is in contact with and applies a linear force to trigger piston 66, forcing needle valve 74 and seal packing ring 72 outward into compressed air collection chamber 24. This action allows compressed air from the compressed air collection chamber 24 to exit through needle valve 74. During this process, the air pressure suddenly becomes unequal between compressed air collection chamber 24 and compressed air storage chamber 14, causing piston 26 to quickly rebound and separate from sealing nut cap 46. Compressed air from compressed air storage chamber 14 then rapidly explodes into and through compressed air output passage 50, out of drain clearing compressed air device 10, and down the blocked drain or pipe, creating an immediate increase in water pressure sufficient enough to clear the blockage.

Figure 6:
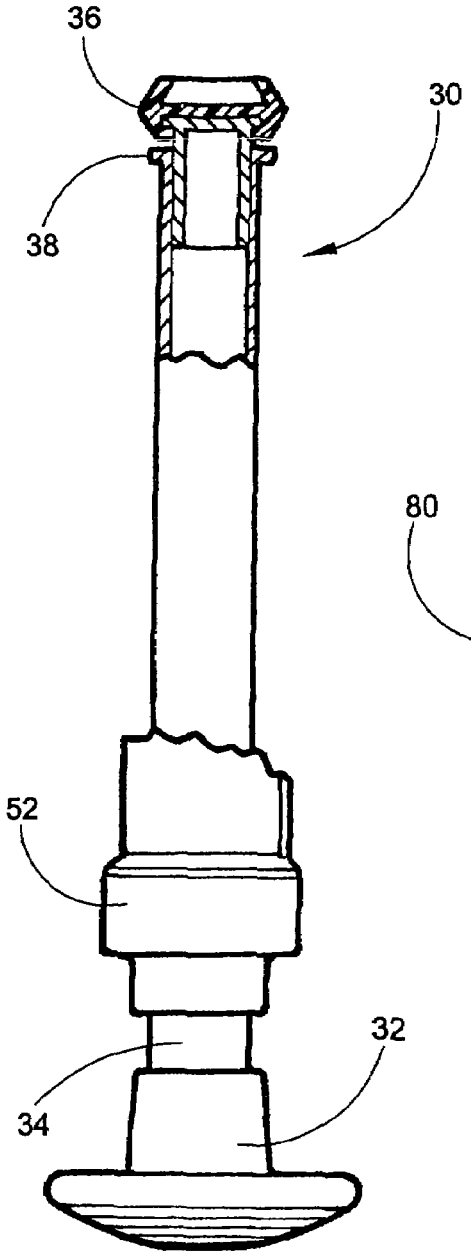
FIG. 6 depicts a profile and cross-sectional view of the manual pump, constructed in accordance with the present invention.

Referring now to FIG. 6, there is shown a cross-sectional view of manual pump 30. Pump collar 52 is used to slidably and sealingly position pump rod 34 within drain clearing compressed air device 10. One end of pump rod 34 is connected to pump handle 32, and the other end of pump rod 34 is connected to plunger 36 by locking ring 38.

Figure 7:
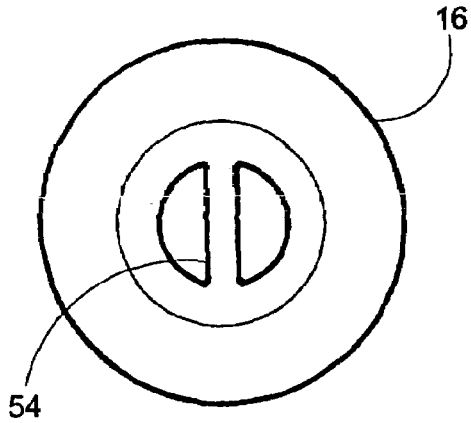
FIG. 7 depicts a bottom view of the drain-sealing adapter fitting located at the bottom of the lower body of the drain clearing compressed air device, constructed in accordance with the present invention.

Referring now to FIG. 7, there is shown a plan view of drain-sealing adapter fitting 16 of the drain clearing compressed air device 10. The drain-sealing adapter fitting 16 contains a transverse obstruction 54 to prevent large particles from entering drain clearing compressed air device 10.

Figure 8:
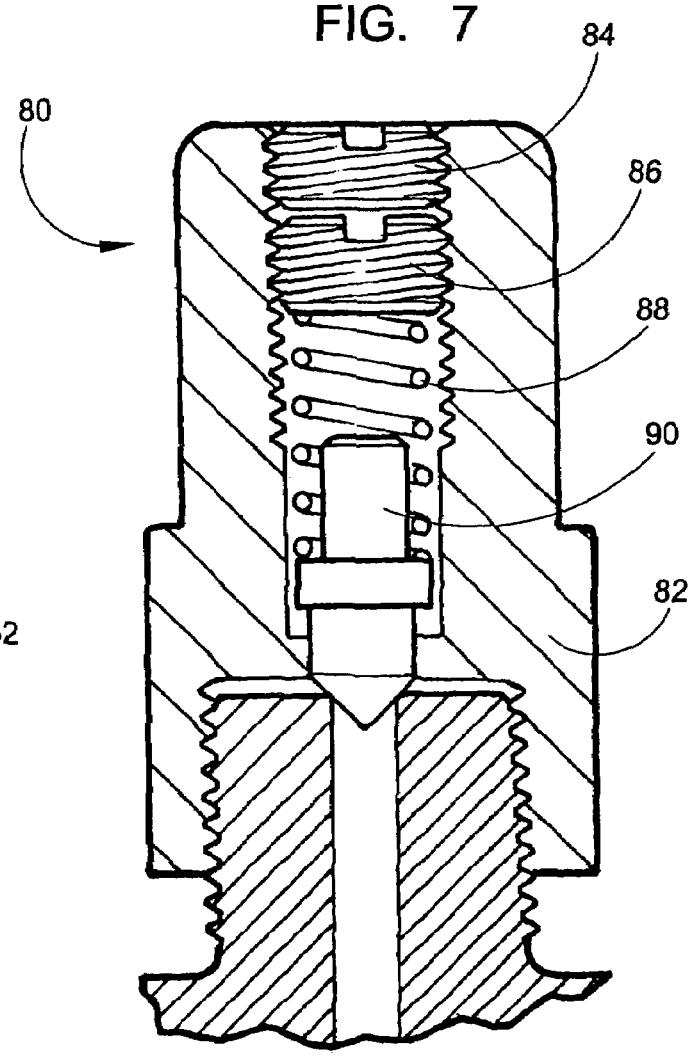
FIG. 8 depicts a cross-sectional view of a second embodiment of the pressure release safety component, constructed in accordance with the present invention.

Referring now to FIG. 8, there is shown a cross-sectional view of an alternate embodiment of the pressure release safety component 80 (as first shown in FIG. 2). Pressure release safety component 80 comprises a safety cover 82, plug 84, fine tuner 86, spring 88, and jam core 90. The operating pressure of drain clearing compressed air device 10 is typically between 0.3-0.45 Mpa. The safety pressure of fine tuner 86 is 0.45-0.55 Mpa. Fine tuner 86 adjusts the pressure of spring 88 using a screwing action. When the inner pressure of compressed air storage chamber 14 exceeds the safety pressure of fine tuner 86, spring 88 cannot be compressed by trigger piston 66, and jam core 90 will be jammed. Excess pressure is then released from plug 84 and fine tuner 86 to ensure safe usage of drain clearing compressed air device 10. No adjustments to pressure release safety component 80 are needed since it is manufactured to maintain the required air pressure.

Referring now to FIG. 9 there is depicted a detachable drain-sealing adapter to be used with the drain clearing compressed air device for unclogging sinks/basins.

Referring now to FIG. 10, there is depicted a detachable drain-sealing adapter to be used with the drain clearing compressed air device, in conjunction with the adapter to unclog sinks/basins shown in FIG. 9, for unclogging open surface drains, bathtubs, or toilets.

Referring now to FIG. 11, there is shown another detachable drain-sealing adapter to be used with the drain clearing compressed air device for unclogging sinks/basins.

Referring now to FIG. 12, there is depicted another detachable drain-sealing adapter to be used with the drain clearing compressed air device for unclogging sinks/basins.

Referring now to FIG. 13, there is depicted another detachable drain-sealing adapter to be used with the drain clearing compressed air device for unclogging surface drains or bathtubs.

Referring now to FIG. 14, there is shown another detachable drain-sealing adapter to be used with the drain clearing compressed air device for unclogging surface drains and toilets.

Referring now to FIG. 15, there is depicted a detachable drain-sealing adapter to be used with the drain clearing compressed air device for unclogging sinks/basins or bathtubs that contain a lift plug.

Referring now to FIG. 16, there is shown another detachable drain-sealing adapter to be used with the drain clearing compressed air device for unclogging surface drains, bathtubs, or toilets.

Referring now to FIG. 17, there is shown a partial cross-sectional view of the drain clearing compressed air device with a drain-sealing adapter, as shown in FIG. 13, attached to the drain clearing compressed air device 10 at the drain-sealing adapter fitting 16 (see FIG. 1) located at the lower portion of the compressed air storage chamber 14. All of the drain-sealing adapters, as shown in FIGS. 9 through 16 are made of resilient materials and fit into place over the rounded portion of the drain-sealing adapter fitting 16.

The drain clearing compressed air device and the various drain-sealing adapters of the present invention, as shown in the drawings and described in detail, herein discloses an arrangement of elements of particular construction and configuration for illustrating the preferred embodiment of structure and method of operation of the present invention. It is to be understood however, that elements of different construction and configuration and other arrangements thereof, other than those illustrated and described may be employed for providing a drain clearing compressed air device in accordance with the spirit of this invention, and such changes, alternations, and modifications as would occur to those skilled in the art are considered to be within the scope of this invention as broadly defined in the appended claims.

Further, the purpose of the foregoing abstract is to enable the United States Patent and Trademark Office, the general public, and especially the scientists, engineers, and practitioners in the art who are not familiar with patent or legal terms or phraseology, to quickly determine the nature and essence of the technical disclosure of the application from a cursory inspection. The abstract is neither intended to define the invention of the application, which is measured by the claims, nor is it intended to be limiting as to the scope of the invention in any way.

I claim:

1. A self-contained handheld drain clearing compressed air device comprising:

(a) a handle assembly including a compression chamber, said compression chamber having a first end, a second end, and an interior area bounded by said first end and said second end, a one-way air inlet valve positioned at said second end, a pump rod sealingly and slidably positioned within said interior area, said pump rod extending through said first end of said compression chamber, said pump rod having two ends, one end of said pump rod coupled to a pump handle, the other end of said pump rod coupled to a plunger;

(b) a trigger component having an inner mechanism and an exterior handle, said inner mechanism consisting of a trigger piston, a trigger spring, a cushion, a seal packing ring, and a needle valve, said exterior handle connected to said handle assembly by a pin, said exterior handle having a first position and a second position, said first position consisting of the exterior handle being uncontacted with said trigger piston, said second position consisting of the exterior handle being in contact with said trigger piston;

(c) safety means for releasing pressure, said safety means externally fixed beyond said second end of said compression chamber;

(d) a compressed air collection chamber positioned inwardly from said trigger component and below said second end of said compression chamber, said compressed air collection chamber having an open end, a closed end, and a piston removably positioned within said compressed air collection chamber, said piston having an open end, a closed end, and an air outlet hole positioned towards said closed end;

(e) a compressed air storage chamber having a first end containing external threads for combining with said handle assembly, a second end containing a drain-sealing adapter fitting, a centrally located compressed air discharge passage, a sealing nut cap positioned over said compressed air discharge passage, and a fixed locking ring coupled to said compressed air discharge passage;

whereby a user pumps said manual pump, forcing compressed air through said one-way air inlet valve and into said compressed air collection chamber, causing said piston to slide outward and against said sealing nut cap, resulting in exposure of said air outlet hole in said piston from which said compressed air flows into said compressed air storage chamber where it is stored until said user moves said trigger handle into said second position, wherein said needle valve extends into said compressed air collection chamber and causes a pressure drop in said compressed air collection chamber that causes said piston to rebound and lose sealing contact with said sealing nut cap, resulting in an explosion of said compressed air into and through said compressed air output passage.

2. The self-contained handheld drain clearing compressed air device of claim 1, wherein said safety means for releasing pressure is comprised of:

(a) a threaded sealing nut cap, having an orifice therethrough;

(b) a frangible membrane and an O-ring held in place between said threaded sealing nut cap and said compressed air storage chamber;

whereby when the air pressure within said compressed air storage chamber exceed safe levels, said frangible membrane breaks safely releasing the unsafe compressed air into the atmosphere through said orifice in said threaded sealing nut cap.

3. The self-contained handheld drain clearing compressed air device of claim 1, wherein said handle assembly including a compression chamber is fixed at an angle of about 80 degrees to about 110 degrees relative to said compressed air storage chamber.

4. The self-contained handheld drain clearing compressed air device of claim 1, wherein the exterior surface of said compressed air storage chamber is ribbed.

5. The self-contained handheld drain clearing compressed air device of claim 1, further comprising a drain-sealing adapter attached to said drain-sealing adapter fitting, said drain-sealing adapter having a first end for attachment to said self-contained drain clearing compressed air device, and a second end formed for placement within a drain opening.

6. The self-contained handheld drain clearing compressed air device of claim 5, wherein said drain-sealing adapter is comprised of a resilient material.

7. The self-contained handheld drain clearing compressed air device of claim 1, wherein said safety means is adjustable to provide varying levels of air pressure.

8. The self-contained handheld drain clearing compressed air device of claim 1, wherein said safety means comprises:

(a) a jam core;

(b) a spring positioned over said jam core;

(c) tuning means for adjusting air pressure, said tuning means positioned over said spring;

(d) a plug positioned over said tuning means; and (e) cover means for protecting said pressure release safety component, said cover means housing said pressure release safety component;

whereby when the inner pressure of said compressed air storage chamber exceeds the safety pressure of said tuning means, said spring cannot be compressed by said trigger piston and said jam core will be jammed, causing the release of excess pressure from said plug and said tuning means.

9. The self-contained handheld drain clearing compressed air device of claim 1, wherein a transverse obstruction is positioned across the opening of said drain-sealing adapter fitting to prevent material from entering said compressed air discharge passage.

10. The self-contained handheld drain clearing compressed air device of claim 1, wherein said fixed locking ring contains one or more openings to allow the passage of compressed air into the lower end of said compressed air storage chamber.

11. The self-contained handheld drain clearing compressed air device of claim 1, wherein said one-way air inlet valve contains a protruding head to facilitate maintenance.

12. The self-contained handheld drain clearing compressed air device of claim 1, wherein said compressed air storage chamber is substantially cylindrical in shape.

13. A method for making a self-contained handheld drain clearing compressed air device, comprising the steps of:

(a) providing a handle assembly including a compression chamber, said compression chamber having a first end, a second end, and an interior area bounded by said first end and said second end, a one-way air inlet valve positioned at said second end, a pump rod sealingly and slidably positioned within said interior area, said pump rod extending through said first end of said compression chamber, said pump rod having two ends, one end of said pump rod coupled to a pump handle, the other end of said pump rod coupled to a plunger;

(b) providing a trigger component having an inner mechanism and an exterior handle, said inner mechanism consisting of a trigger piston, a trigger spring, a cushion, a seal packing ring, and a needle valve, said exterior handle connected to said handle assembly by a pin, said exterior handle having a first position and a second position, said first position consisting of the exterior handle being uncontacted with said trigger piston, said second position consisting of the exterior handle being in contact with said trigger piston;

(c) providing safety means for releasing pressure, said safety means externally fixed beyond said second end of said compression chamber;

(d) providing a compressed air collection chamber positioned inwardly from said trigger component and below said second end of said compression chamber, said compressed air collection chamber having an open end, a closed end, and a piston removably positioned within said compressed air collection chamber, said piston having an open end, a closed end, and an air outlet hole positioned towards said closed end; and (e) providing a compressed air storage chamber having a first end containing external threads for combining with said handle assembly, a second end containing a drain-sealing adapter fitting, a centrally located compressed air discharge passage, a sealing nut cap positioned over said compressed air discharge passage, and a fixed locking ring coupled to said compressed air discharge passage.

14. The method for making a self-contained handheld drain clearing compressed air device according to claim 12, further comprising the step of providing said safety means wherein said safety means comprises:

(a) a threaded sealing nut cap, having an orifice therethrough;

(b) a frangible membrane and an O-ring held in place between said threaded sealing nut cap and said compressed air storage chamber;

whereby when the air pressure within said compressed air storage chamber exceed safe levels, said frangible membrane breaks safely releasing the unsafe compressed air into the atmosphere through said orifice in said threaded sealing nut cap.

15. The method for making a self-contained handheld drain clearing compressed air device according to claim 12, further comprising the step of providing said safety means wherein said safety means comprises:

(a) a jam core;

(b) a spring positioned over said jam core;

(c) tuning means for adjusting air pressure, said tuning means positioned over said spring;

(d) a plug positioned over said tuning means; and (e) cover means for protecting said pressure release safety component, said cover means housing said pressure release safety component.

16. The method for making a self-contained handheld drain clearing compressed air device according to claim 12, wherein said step of providing a handle assembly including a compression chamber further includes providing a handle assembly fixed at an angle of about 80 degrees to about 110 degrees relative to said compressed air storage chamber.

* * * * *